United States Patent [19]

Arai et al.

[11] Patent Number: 4,663,021

[45] Date of Patent: May 5, 1987

[54] PROCESS OF PRODUCING CARBONACEOUS PITCH

[75] Inventors: Tomio Arai, Zushi; Takao Nakagawa, Ichikawa; Fumio Mogi, Tokyo; Noriaki Oshiguri, Omigawa, all of Japan

[73] Assignees: Fuji Standard Research, Inc., Tokyo; Sumitomo Metal Industries, Ltd., Osaka, both of Japan

[21] Appl. No.: 815,924

[22] Filed: Jan. 3, 1986

[30] Foreign Application Priority Data

Jan. 16, 1985 [JP] Japan ..... 60-5577

[51] Int. Cl.[4] ..... C10G 51/02; C10C 1/00; C10C 3/00

[52] U.S. Cl. ..... 208/67; 208/39; 208/40; 208/49; 208/72; 208/106

[58] Field of Search ..... 208/39, 40, 67, 72, 208/106; 423/447.1

[56] References Cited

U.S. PATENT DOCUMENTS

| | | | |
|---|---|---|---|
| 4,242,196 | 12/1980 | Aiba et al. | 208/40 |
| 4,340,464 | 7/1982 | Aiba et al. | 208/40 |
| 4,430,197 | 2/1984 | Poynor et al. | 208/67 |
| 4,454,019 | 6/1984 | Izumi et al. | 208/39 |
| 4,472,265 | 9/1984 | Otani | 208/22 |
| 4,477,334 | 10/1984 | Gomi et al. | 208/67 |
| 4,487,686 | 12/1984 | Gomi | 208/67 |
| 4,504,455 | 3/1985 | Otani et al. | 423/447.4 |
| 4,511,625 | 4/1985 | Mazem et al. | 208/22 |
| 4,514,282 | 4/1985 | Poynor et al. | 208/67 |
| 4,554,148 | 11/1985 | Gomi et al. | 208/40 |
| 4,581,124 | 4/1986 | Gomi et al. | 208/72 |

*Primary Examiner*—Andrew H. Metz
*Assistant Examiner*—Helane Myers
*Attorney, Agent, or Firm*—Pahl, Lorusso & Loud

[57] ABSTRACT

A continuous process of producing carbonaceous pitch, including heat-treating an aromatic heavy oil for obtaining a first cracked product, and thermally cracking the first product in a cracking zone by direct contact with a gaseous heat transfer medium to obtain distillable cracked components and a mesophase-containing pitch. A first portion of the liquid phase in the cracking zone, including the mesophase-containing pitch, is separated into a mesophase-rich pitch and a matrix pitch having a low concentration of mesophase. The mesophase-rich pitch is recovered while at least a portion of the matrix pitch is recycled to the cracking zone. The distillable cracked components are withdrawn from the cracking zone and separated into light, middle and heavy fractions. At least a portion of the heavy fraction is heat treated and is recycled to the cracking zone. A least a portion of the middle fraction and/or a portion of the heavy fraction is hydrotreated to obtain a hydrogen-donating oil which is then reacted with a second portion of the liquid phase to hydrogenate the mesophase contained therein, the reaction product being recycled to the cracking zone.

8 Claims, 2 Drawing Figures

PROCESS OF PRODUCING CARBONACEOUS PITCH

Figure 1:
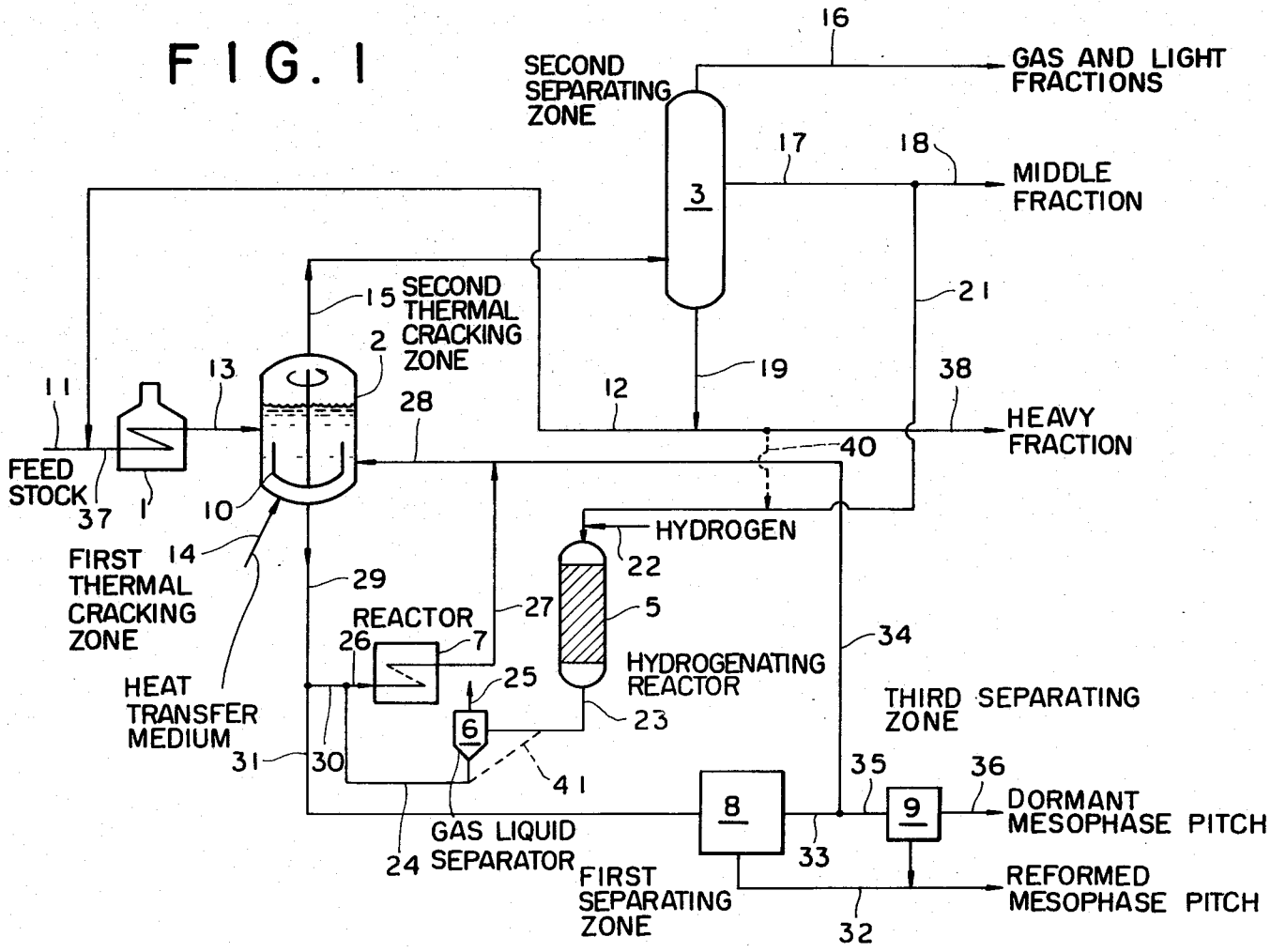

This invention relates to a process of producing carbonaceous pitch useful for use as a precursor material for carbon fibers.

As precursor materials for carbon fibers, polyacrylonitrile fibers have been hitherto employed. Due to the expensiveness and poor carbon yield of the polyacrylonitrile fibers, however, a number of studies have been made in recent years to utilize carbonaceous pitch as raw materials for carbon fibers. As starting material carbonaceous pitch for the production of carbon fibers, both optically isotropic and anisotropic pitches have been employed. Natural and synthetic pitches are generally isotropic in nature and afford isotropic carbon fibers with low-strength and low-modulus. On the other hand, anisotropic pitches can form carbon fibers having a strength and a modulus as high as those obtained from rayon or acrylic fibers. Therefore, the recent trend in the production of carbon fibers is towards the use of anisotropic pitches as starting materials. Thus, a number of processes have been hitherto proposed for the production of pitches useful as precursor materials for carbon fibers. However, most of the known processes should be carried out in a batch or semi-batch mode in order to avoid coking troubles.

In accordance with the present invention, there is provided a process of producing carbonaceous pitch, comprising the steps of:

(a) feeding an aromatic heavy oil into a first thermal cracking zone for thermally cracking the aromatic heavy oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone and introducing a first portion of said liquid phase into a first separating zone for separating same into a mesophase-rich pitch having a higher concentration of mesophase than the liquid phase and a matrix pitch having a lower concentration of mesophase than the liquid phase;

(d) recycling at least a portion of said matrix pitch to said second thermal cracking zone;

(e) removing said stripped, distillable cracked components overhead from said second cracking zone and introducing same into a second separating zone for separating same into a light fraction, a middle fraction and a heavy fraction;

(f) hydrotreating at least a portion of said middle fraction and/or a portion of said heavy fraction to obtain a hydrogen-donating oil;

(g) reacting said hydrogen-donating oil with a second portion of said liquid phase to hydrogenate said liquid phase;

(h) recycling the reaction product obtained in step (g) to said second thermal cracking zone;

(i) heat treating at least a portion of said heavy fraction and recycling said heat-treated portion to said second thermal cracking zone; and (j) recovering said mesophase-rich pitch.

The process of the present invention will now be described in detail below.

1. First Thermal Cracking Step:

Any heavy hydrocarbon oil having a high aromatic carbon content may be used as a feed stock for producing a carbonaceous pitch according to the process of the present invention. Examples of such highly aromatic heavy oil include heavy petroleum hydrocarbons such as thermal cracking residues, catalytic cracking residues and catalytic hydrocracking residues and heavy coal hydrocarbons such as coal tar and heavy liquefied coal oil. The highly aromatic heavy oil preferably has a boiling point of at least 350° C., more preferably 400°–520° C., and an $f_a$ value (a ratio of the number of aromatic carbon atoms to the total number of carbon atoms) of 0.4–0.9, more preferably 0.5–0.8. The $f_a$ value may be calculated in accordance with the Brown-Ladner method from the results of an elementary analysis and proton NMR.

The aromatic heavy oil is fed to a first thermal cracking zone for thermally cracking same and for obtaining a first, thermally cracked product. In the first thermal cracking step, the aromatic heavy oil also undergoes polycondensation and aromatization to form pitch. The feed stock oil is preferably preheated to a temperature not higher than 350° C. before it is fed to the first cracking zone. It is also preferred that the feed stock be fed to the first thermal cracking zone after the removal of a portion of its light hydrocarbon components as described hereinafter. Preferably, the first thermal cracking zone is a cracking furnace provided with a tubular reactor through which the aromatic heavy oil feed is streamed to undergo the thermal cracking. The thermal cracking in the first thermal cracking zone is preferably carried out at a temperature of 450°–520° C., more preferably 480°–510° C., and a pressure of from normal pressure to 30 $Kg/cm^2G$, more preferably at a pressure in the outlet port of the cracking zone of 1–5 $Kg/cm^2G$, for a period of time of 1–30 min, more preferably 1.5–20 min, while substantially preventing the occurrence of coking. It is advisable to add water to the aromatic heavy oil feed in an amount of 0.3–3% based on the weight of the heavy oil feed for the purpose of increasing the linear velocity of the aromatic heavy oil feed streamed through the tubular reactor and thereby preventing the occurrence of coking.

2. Second Thermal Cracking Step:

The first, thermally cracked product obtained in the first thermal cracking step is continuously fed to a second thermal cracking zone where it is contacted with a gaseous heat transfer medium to further thermally crack the first product and to form a second, thermally cracked product including distillable cracked components and a mesophase-containing pitch which constitutes a liquid phase in the second thermal cracking zone. The distillable cracked components are stripped from the liquid phase with the gaseous heat transfer medium. The second thermal cracking step is preferably performed under a reduced pressure or under such a condition as to reduce the partial pressure of the distillable cracked components in the second thermal cracking zone.

The second thermal cracking zone is a continuous-type reactor preferably equipped with an agitator. The reactor is provided with a feed port through which the first cracked product from the first cracking zone is supplied thereto, a withdrawing port through which the distillable cracked components are removed therefrom together with the gaseous heat transfer medium, a discharge port through which the liquid phase is discharged therefrom, a recycling port through which a matrix pitch obtained from the liquid phase in a separating zone described hereinafter is recycled thereto, a recirculating port through which a hydrogenated mesophase-containing material described hereinafter is recycled thereto and an injecting port through which the gaseous heat transfer medium is supplied thereto for contact with the liquid phase contained therein. When a third thermal cracking zone is employed as described hereinafter, the second thermal cracking zone is further provided with a port through which the cracked product from the third cracking zone is supplied.

Thus, in the second cracking zone, the liquid phase including the first product from the first cracking zone, the matrix pitch from the separating zone, the hydrogenated mesophase-containing material and, as the case may be, the cracked product from the third thermal cracking zone, is contacted with the heat transfer medium so that its distillable components are stripped and withdrawn overhead from the second cracking zone. At the same time, the liquid phase is subjected to thermal cracking conditions by direct heat exchange with the heat transfer medium, thereby to form the distillable cracked components (cracked light oil and cracked gas) and a pitch due to the polycondensation and aromatization reactions inherent to ther thermal cracking. The distillable cracked components thus formed are stripped with the heat transfer medium from the liquid phase and removed from the second cracking zone together with the heat transfer medium. The thermal cracking in the second thermal cracking zone is carried out so that a substantial amount, preferably 5–25% by weight based on the liquid phase, of mesophase, preferably having a weight average particle diameter of 10–200 μm, is formed. The mesophase is homogeneously dispersed in the liquid phase (pitch phase) in the second cracking zone.

In order to form the pitch in which the mesophase is homogeneously dispersed, it is important that the distillable cracked components should be stripped from the pitch phase (liquid phase). If the thermal cracking is performed in the presence of a large amount of the volatile cracked components, the mesophase will grow large and coalesce with each other and coking will be apt to occur. By controlling the thermal cracking temperature and the partial pressure of the gas phase (i.e. the total partial pressure of the cracked gas and the oil vapor in the heat transfer medium), the pitch phase in which the mesophase with suitable properties, concentration and size is homogeneously dispersed may be produced, whereby the separation of the pitch phase into a matrix pitch and a mesophase-rich pitch as hereinafter described may be effectively performed.

The thermal cracking conditions in the second thermal cracking zone vary with the properties of the first cracked product fed from the first cracking zone. Generally, the thermal cracking in the second cracking zone is performed at a temperature of 410°–460° C., preferably 430°–450° C., a pressure or a partial pressure of the gas phase of 30–200 mmHg, preferably 40–100 mmHg, with a residence time of the liquid phase in the second cracking zone of 3–120 min, preferably 5–90 min.

The gaseous heat transfer medium is preferably a substantially oxygen-free, non-oxidative gas such as steam, a hydrocarbon gas, a perfect combustion waste gas or an inert gas such as nitrogen or argon and has generally a high temperture, preferably of 400°–800° C. Since the heat required for effecting the second thermal cracking step is mainly supplied from the products obtained in the first thermal cracking zone, the temperature of the gaseous heat transfer medium need not be very high.

For the purpose of preventing coking from occurring on the inside wall of the second thermal cracking reactor at a portion higher than the level of the liquid phase, that portion of the reactor may be cooled by direct or indirect contact with cooling water. Alternatively, to achieve this purpose, the matrix pitch to be recycled to the second cracking zone may be introduced in such a manner as to travel on the inside wall of the reactor and to continually wet and wash the surface thereof. In either case, it is preferred that the temperature in the upper space of the liquid phase be 30°–60° C. lower than that of the liquid phase.

3. Separtion of Liquid Phase:

The liquid phase in the second cracking zone is continuously discharged therefrom and a portion (a first portion) of the discharged liquid phase is introduced into a first separating zone where the first portion of the liquid phase is separated into a matrix pitch and a mesophase-rich pitch such that the concentration of the mesophase is decreased in the matrix pitch and is increased in the mesophase-rich pitch as compared with the liquid phase. At least a portion of the matrix pitch is recycled to the second cracking zone, as described previously, for controlling both the concentration and verage residence time of mesophase of the liquid phase in the second cracking zone and for thereby preventing the occurrence of coking. Thus, the recycling of the matrix pitch makes it possible to continuously perform the second thermal cracking step. It is preferred that the matrix pitch be recycled to the second thermal cracking zone in an amount so that the concentration of mesophase in the liquid phase is maintained at 5–25% by weight, more preferably 10–20% by weight. Too high a concentration of mesophase causes the occurrence of coking and the broadening of the residence time distribution of mesophase in the second thermal cracking zone, resulting in the unevenness of the physical properties of mesophase such as molecular weight distribution and softening point.

The mesophase-rich pitch is recovered, preferably continuously, as a pitch product useful as a precursor material for the production of high strength carbon fibers. Preferably, the mesophase-rich pitch has a mesophase content of at least 50% by weight, more preferably at least 80% by weight. The mesophase-rich pitch thus produced can be "reformed mesophase pitch" as defined in U.S. Pat. No. 4,504,455 for the reasons described hereinafter. If desired, a portion of the matrix pitch may be also recovered as product after the removal of its mesophase by means of, for example, a filtering device. The substantially mesophase-free matrix pitch may be used, for example, as a precursor pitch for the production of carbon fibers. Such an isotropic pitch can be "dormant mesophase pitch" as defined in U.S. Pat. No. 4,472,265 for the reasons as described hereinafter.

The separation of the liquid phase into the matrix pitch and the mesophase-rich pitch may be effected by any known method generally utilized for liquid-solid separation, such as sedimentation and centrifuge.

It is advisable to reduce the residence time of the pitch phase in the separation zone. The temperature at which the separation is performed varies with the kind and the properties of the pitch to be treated and the properties of the mesophase-rich pitch product. Generally, the separation is performed at a temperature of 200°–450° C., preferably 300°–400° C. If, in the separation step, the liquid phase is subjected to a high temperature for a long period of time, there is a danger that the reactions resulting in the formation of pitch proceed further and coking troubles are liable to occur. Too low a separation temperature, on the other hand, will cause the increase of the viscosity of the liquid phase, resulting in the reduction in separation efficiency.

If desired, a portion of the heavy fraction and/or light fraction obtained in the fractionating step (second separating step) described hereinafter may be fed to the first seprating zone. By this, the viscosity and the temperature of the liquid phase to be treated may be lowered and, therefore, the separation may be efficiently conducted without encountering coking troubles.

4. Separation of Distillable Cracked Components:

The distillable cracked components (cracked gas and cracked oil) in the second thermal cracking zone are removed overhead therefrom together with the gaseous heat transfer medium and are fed to a second separating zone, generally one or more distillation towers, where they are separated into a heavy fraction, for example, with a boiling point of above 400° C., a middle fraction, for example, with a boiling point of 300°–400° C., a light fraction, for example, with a boiling point of below 300° C., and a gas fraction. The light and gas fractions and, if desired, a portion of the middle and/or heavy fractions are recovered as products, while at least a portion of the middle fraction and/or a portion of the heavy fraction are fed to a hydrotreating zone. At least a portion of the heavy fraction is thermally treated and the resulting heat-treated fraction is recycled to the second thermal cracking zone for the purpose of improving the yield of the pitch product and of controlling the properties of the pitch product.

The second separating zone may be constituted from two or more distillation towers connected in series. Thus, for example, the distillable cracked components from the second thermal cracking zone are first introduced into a primary distillation tower where they are separated into a bottom fraction and a lighter fraction. The lighter fraction is then fed to a secondary distillation tower where it is separated into gas, light, middle and heavy fractions. The bottom fraction in the primary distillation tower is discharged therefrom as the above-described heavy fraction and at least a portion thereof is recycled to the second thermal cracking zone after being subjected a heat treatment in either the first thermal cracking zone or third thermal cracking zone.

As described previously, the aromatic heavy oil feed stock is preferably fed to the first thermal cracking zone after the removal of its volatile components. This can be done by feeding the feed stock to the second separating zone. For example, when the second separating zone is formed from a single distillation tower, the feed stock is fed to a lower portion of the distillation tower thereby to distill off the volatile components contained in the feed stock. The residual oil which is thus formed of (1) the heavy fraction separated from the distillable cracked components from the second thermal cracking zone and (2) the feed stock from which volatile components are removed, is introduced into the first thermal cracking zone. When the second separating zone is constituted from, for example, two distillation towers as described above, the feed stock is fed to a lower portion of the secondary distillation tower to which the distillate from the primary distillation tower is fed. The residual fraction in the secondary distillation tower, which is mainly composed of the feed stock from which volatile components are removed, is mixed with at least a portion of the bottom fraction from the primary distillation tower and the mixture is fed to the first thermal cracking zone. It is of course possible to introduce the feed stock directly into the first thermal cracking zone.

5. Third Thermal Cracking Step:

As described previously, at least a portion of the heavy fraction from the second separating zone is recycled, after being heat treated, to the second thermal cracking zone. By the heat treatment, the heavy fraction is converted into light oil components and a pitch product. The heat treatment of the heavy fraction may be effected in the first thermal cracking zone. Thus, in this case, the heavy fraction is fed to the first thermal cracking zone together with the aromatic heavy oil feed stock. Alternatively, the heat treatment of the heavy fraction may be effected by introducing same into a third thermal cracking zone.

The third thermal cracking zone may be a conventional tubular reactor disposed within a furnace. Since the heavy fraction has once experienced thermal hysteresis and is slow in cracking rate, the third thermal cracking step is generally performed at a temperature higher than the temperature at which the first thermal cracking is performed. The third thermal cracking step is generally performed at a temperature of 450°–530° C., preferably 500°–520° C., a pressure of 0.1–50 Kg/cm$^2$G, preferably a pressure at the outlet of the third cracking zone of 2–5 Kg/cm$^2$G, for a period of time of 1–30 min, preferably 3–20 min. The pitch thus produced is then fed either by itself or together with the light oil components to the second thermal cracking zone, preferably into the liquid phase in the second thermal cracking zone. When the pitch product alone is introduced into the second thermal cracking zone, the product in the third cracking zone is first fed to a separating zone, such as a flush separator, for the separation of the pitch from the light oil components.

Even when the thermal treatment of the heavy fraction is effected in the third thermal cracking zone, it is preferred that a portion of the heavy fraction be fed to the first thermal cracking zone, generally in an amount of 10–30% by weight of the aromatic heavy oil feed, for reasons of preventing the occurrence of coking in the first thermal cracking zone. In this case, when the second separating zone has two, primary and secondary distilllation towers and the feed stock is first fed to the second distillation tower for the removal of its volatile components, as described above, a portion of the bottom fraction from the primary distillation tower may be mixed with the residual fraction from the secondary distillatioh tower and the mixture may be fed to the first thermal cracking zone while the remaining portion of the bottom fraction from the primary distillation tower may be introduced into the third thermal cracking zone.

6. Hydrotreating Step:

A least a portion of the middle fraction (having a boiling point of 300°–400° C., for example) and/or a portion of the heavy fraction (having a boiling point of above 400° C., for example) obtained in the second separating zone are introduced into a hydrotreating zone for partially hydrogenating aromatic compounds contained therein. By the partial hydrogenation, aromatic compounds are converted into hydroaromatic compounds so that the resulting hydrotreated oil becomes hydrogen-donating oil.

Various suitable methods for hydrotreating petroleum fractions are known in the art. By way of example, one such method includes passing the middle and/or heavy fraction over a fixed bed of a suitable catalyst at an elevated temperature and a suitable hydrogen pressure. It is of course possible to adopt a homogeneous phase catalytic hydrogenation using a complex catalyst or a heterogeneous phase catalytic hydrogenation using, other than a fixed bed, such as ebullated bed or suspended bed.

The hydrogenation conditions vary with the kind of the catalyst used, conditions employed in the succeeding step, etc. Generally, however, the hydrogen treatment is performed at a temperature of 250°–450° C., preferably 300°–420° C., and a hydrogen pressure of 20–250 Kg/cm$^2$G, preferably 30–150 Kg/cm$^2$G. A suitable catalyst may, for example, be V, Mo, W, Cr, Co, Ni, Cu or a combination thereof supported on a refractory inorganic carrier such as disclosed in Japanese Published Unexamined Patent Application No. 59-122,586.

7. Hydrogenation of Mesophase-Containing Pitch (Liquid Phase):

The hydrotreated oil (hydrogen-donating oil) obtained in the hydrotreatment step is then contacted, either as such or after the removal of its gaseous components, with a portion (a second portion) of the liquid phase discharged from the second thermal cracking zone, so that the hydrogen is transferred from the hydrogen-donating oil to the liquid phase. That is, the liquid phase is reacted with the hydroaromatic compounds contained in the hydrogen-donating oil to form partially hydrogenated mesophase and partially hydrogenated matrix pitch. The hydrogenation of the liquid phase may be continuously and easily performed because the reation is effected in a homogeneous liquid phase.

The hydrogenation is generally performed at a temperature of 300°–430° C., preferably 350°–420° C., a pressure of 1–20 Kg/cm$^2$G, preferably 3–15 Kg/cm$^2$G, for a period of time of 1–30 min, preferably 3–20 min with a ratio by weight of the hydrogen-donating oil to the liquid phase of 0.1–10, preferably 0.3–3. Any suitably reactor, such as a tubular reactor or a tower reactor, may be used provided that the two reactants may be sufficiently contacted under the above-described conditions within the reactor. The reaction product containing the partially hydrogenated mesophase and partially hydrogenated matrix pitch is recycled to the second thermal cracking zone to produce reformed mesophase pitch and dormant mesophase pitch.

The process according to the present invention may be thus conducted in a fully continuous mode. Further, the main thermal cracking (second thermal cracking) is effected in a single reactor under a condition so that the distribution of the residence time of the pitch phase in the reactor is concentrated in a narrow range. As a consequence, the thermal cracking may be conducted with a high yield of the pitch product with a high molecular weight while preventing the occurrence of coking. Further, the molecular weight distribution of the pitch product (mesophase-rich pitch and isotropic pitch) is concentrated to a narrow range. Moreover, because the process includes the hydrogenation of liquid phase, the pitch product can be a reformed mesophase pitch and a dormant mesophase pitch. The pitch product is useful not only as a precursor material for carbon fibers but also as a binder, impregnater and a raw material for the production of easily graphatizable carbon materials such as needle coke.

Figure 2:
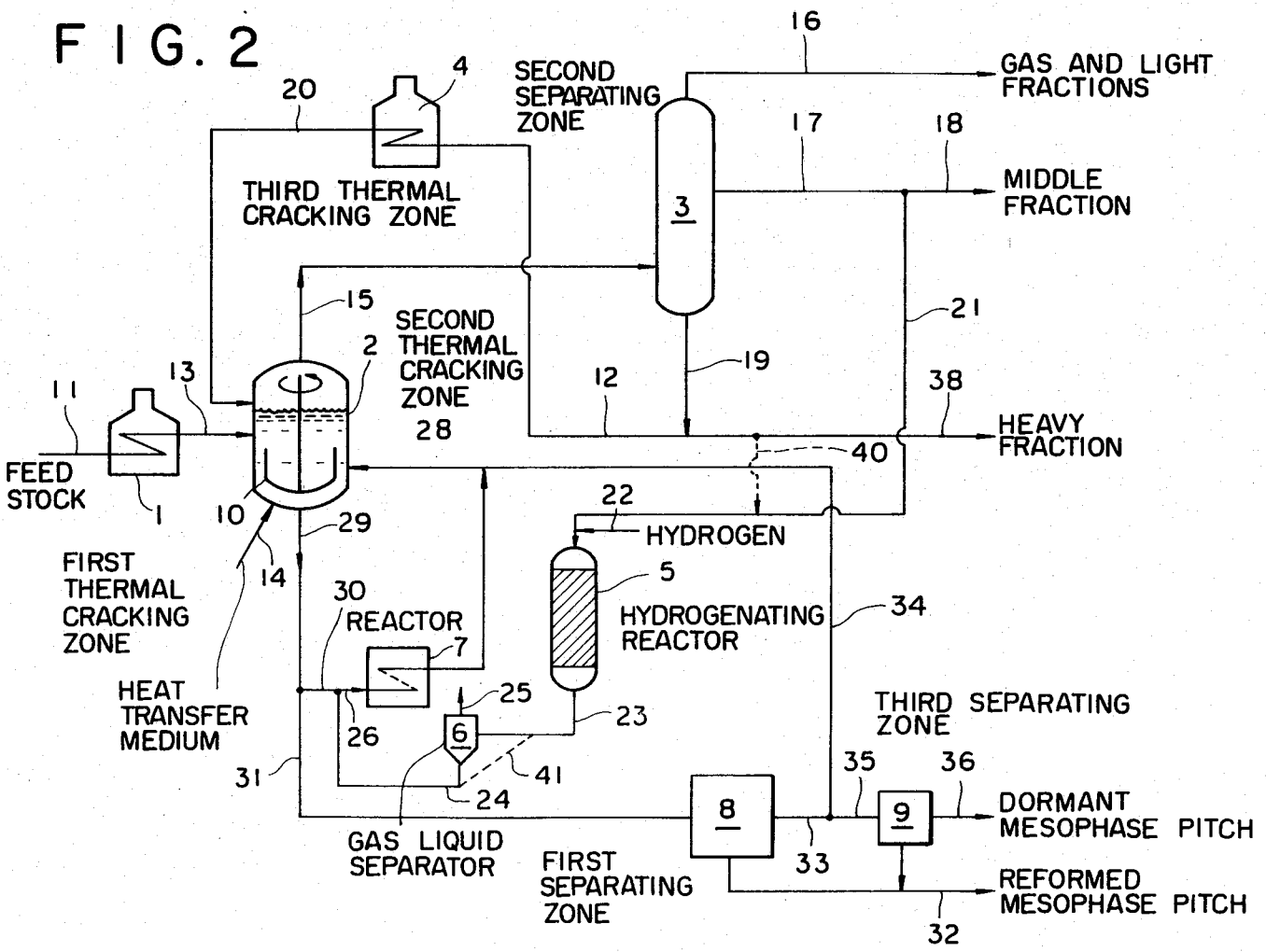

Preferred embodiments according to the present invention will now be described below with reference to the accompanying drawings, in which:

FIG. 1 is a flowdiagram illustrating an apparatus for carrying out the process of the present invention; and FIG. 2 is a flowdiagram illustrating another embodiment of the apparatus, similar to FIG. 1, for carrying out the process of the present invention.

Referring first to FIG. 1, the reference numeral 1 designates a first thermal cracking zone, generally a tubular reactor disposed within a furnace, where a preheated aromatic heavy oil fed through lines 11 and 37 is subjected to thermal cracking to obtain a first thermally cracked product. The first product is then passed to a second thermal cracking zone, generally a cylindrical reactor 2, through a line 13. A gaseous heat transfer medium is continuously supplied through a line 14 to the reaction vessel 2 for direct contact with the liquid phase in the reaction vessel 2 including the first product introduced from the reactor 1. The heat transfer medium serves to stir the liquid phase in the reaction vessel 2, to maintain the temperature of the liquid phase within a predetermined range, and to strip distillable cracked components from the liquid phase. In the reaction vessel 2, the first product is thus subjected to thermal cracking, generally under a reduced pressure or under such a condition that the partial pressure of the thermally cracked components is low, thereby to form mesophase pitch homogeneously dispersed in the liquid phase (pitch phase). Designated as 10 is a stirrer for homogeneously mixing the reaction mixture and for facilitating the stripping.

The distillable cracked components stripped from the liquid phase are withdrawn overhead from the second cracking vessel 2 and fed to a second separating zone, generally a distillation tower 3 through a line 15 together with the gaseous heat transfer medium. The liquid phase is continuously discharged from the reaction vessel 2 through a line 29 while maintaining the liquid level of the liquid phase in the reaction vessel 2 at a predetermined level.

A first portion of the liquid phase discharded through the line 29 is passed through a line 31 to a first separating zone 8, preferably a sedimentation vessel, a centrifuge or a combination of them, where it is separated into a mesophase-rich pitch and a matrix pitch. The mesophase-rich pitch is withdrawn through a line 32 and cooled for recovery as a solid pitch product (reformed mesophase pitch). The matrix pitch is withdrawn through a line 33 and a portion thereof is recycled to the reaction vessel 2 through a line 34 and a line 28 for undergoing a further thermal cracking treatment. If desired, a portion of the matrix pitch is diverted from the line 33 and fed to a mesophase separating zone (third separating zone) 9 through a line 35 to remove the mesophase contained therein. The resulting substantially mesophase-free isotropic pitch is discharged through a line 36 for recovery as a dormant mesophase pitch.

The distillable cracked components introduced into the distillation tower 3 are separated into a gas fraction, a light fraction with a boiling point of below 300° C., a middle fraction with a boiling point of 300°–400° C., and a heavy fraction with a boiling point of above 400° C. The gas and light fractions are withdrawn through a line 16 while the middle and heavy fractions are through lines 17 and 19, respectively. A portion of the heavy fraction discharged from the distillation tower 3 is recovered through a line 38 and another portion is fed through a line 12 to the first thermal cracking zone after being mixed with the feed stock from the line 11. A further, remaining portion of the heavy fraction is optionally passed through a line 40 to a line 21 through which the middle fraction flows as described hereinafter.

A portion of the middle fraction discharged from the distillation tower 3 is recovered through a line 18 while the remaining portion is fed to a hydrotreating zone 5 through a line 21. The middle fraction optionally mixed with the heavy fraction supplied through the line 40 is fed to the hydrotreating zone 5 through the line 21 together with hydrogen gas supplied through a line 22, where they are contacted with a fixed bed of a catalyst to produce a hydrogen-donating oil. The hydrogen-donating oil thus produced is then passed through a line 23 to a gas-liquid separator 6.

The gas phase containing unreacted hydrogen and a gasified product is withdrawn from the separator 6 through a line 25 and is recycled to the hydrogen treating zone 5. The hydrogen-donating oil from which the gas phase is removed is introduced through a line 24 and a line 26 into a reactor 7 together with a second portion of the liquid phase diverted from the line 29 and passed through a line 30 to the line 26. The reactor is maintained at a suitable reaction condition so that hydrogen is transferred from the hydrogen-donating oil to the mesophase contained in the liquid phase, thereby to produce hydrogenated mesophase. The reaction product in the reactor 7 is fed through a line 27 and the line 28 to the second thermal cracking zone 2. If desired, the reaction product in the hydrotreating zone 5 may be passed to the line 24 via line 41 without removing the gas components.

FIG. 2 illustrates another embodiment of an apparatus for carrying out the process of the present invention, in which like reference numerals designate like component parts. In this embodiment, a third thermal cracking zone 4 is provided for the thermal treatment of a portion of the heavy fraction obtained in the distillation tower 3. The heat treatment product is recycled to the second thermal cracking zone 2 through a line 20. As compared with the process shown in FIG. 1 in which the recycled heavy fraction is thermally treated in the same cracking zone as that for the feed stock, the process of FIG. 2 treats the recycled heavy fraction and the feed stock in different cracking zones operated under different conditions. Therefore, in the process of FIG. 2, the properties of the pitch product can be more easily controlled than that of FIG. 1.

The following examples will further illustrate the present invention.

EXAMPLE 1

A catalytic cracking residue with a boiling point of 400°–520° C. was used as a starting material for the production of pitch according to the present invention. The feed stock had a specific gravity (15/4° C.) of 1.0998, a sulfur content of 0.81 weight %, an ash conent of below 0.01 weight %, an H/C atomic ratio of 0.99, an $f_a$ value, (in accordance with the Brown-Ladner method) of 0.67 and an average molecular weight (in accordance with the vapor pressure equilibrium method) of 330. The feed stock after being preheated was continuously fed at a feed rate of 100 Kg/hr to an external heat-type tubular reactor (first thermal cracking zone) together with 70 Kg/hr of a heavy fraction supplied from a distillation tower described hereinafter, where the feed was thermally cracked at a temperature of 510° C., a pressure of 5 kg/cm$^2$G for 3 min. The resulting first product was fed to a perfect mixing-type cylindrical reaction vessel (second thermal cracking zone) having an inside volume of 150 liters and equipped with a stirrer and a scraper. A high temperature steam (700° C.) was continuously supplied from the bottom of the reaction vessel at a controlled rate so that the first product was thermally cracked at a temperature of 450° C. with a partial pressure of the cracked product in the gas phase of 180 mmHg.

The overhead product from the reaction vessel was continuously passed to a distillation tower at a rate of 170 Kg/hr to obtain 17 Kg/hr of a light and gas fraction (b.p. of below 350° C.), 53 Kg/hr of a middle fraction (b.p. of 350°–400° C.) and 100 Kg/hr of a heavy fraction (b.p. of 400° C. or more).

A portion (22 kg/hr) of the middle fraction was recovered as a product while the remaining portion (31 Kg/hr) thereof was fed to a hydrogenating zone. A portion (30 Kg/hr) of the heavy fraction was recovered as a product while the remaining portion (70 Kg/hr) thereof was recycled to the first thermal cracking zone as described previously.

The hydrotreating zone was a reactor containing a fixed bed of a catalyst containing Ni-Mo on an inorganic support. The middle fraction and hydrogen were cocurrently passed through the catalyst bed at a temperature of 335° C., a pressure of 35 Kg/cm$^2$G and an LHSV of 1.5 hr$^{-1}$. The properties of the middle fraction and its hydrotreated product were shown in Table 1.

TABLE 1

| | Middle Fraction before Hydro-Treatment | Middle Fraction after Hydro-Treatment |
|---|---|---|
| H/C | 0.90 | 1.00 |
| $f_a$*1 | 0.78 | 0.69 |
| Average Molecular Weight*2 | 190 | 180 |
| $R_a$*3 | 2.2 | 1.5 |
| $R_n$*4 | 1.2 | 1.7 |

*1Calculated according to Brown-Ladner method.
*2Measured according to vapor pressure equilibrium method
*3Number of aromatic rings in one molecule, determined by proton NMR, provided that the rings are condensed rings of a peri-type.
*4Number of naphthenic rings in one molecule, determined by proton NMR, provided that the rings are condensed rings of a peri-type.

The hydrotreated product was then introduced into a gas-liquid separator for the removal of its gas phase ($C_4$ or below) and the liquid phase (hydrogen-donating oil) was introduced into a reactor for the partial hydrogenation of mesophase.

The liquid phase in the reaction vessel (second thermal cracking zone), which had the physical properties shown in Table 2, was continuously discharged therefrom at a rate of 157 Kg/hr and a portion (31 Kg/hr) thereof was fed to the reactor for reaction with the hydrogen-donating oil, with the remaining portion (126

Kg/hr) being fed to a separator of a sedimentation vessel-type. The mesophase hydrogenating reactor was a tubular reactor to which, as described above, the hydrogen-donating oil and 31 Kg/hr of the liquid phase were, after being mixed well with each other, fed for reaction at a temperature of 410° C., a pressure of 5 Kg/cm$^2$G for a period of time of 5 min. The resulting reaction product was then recycled to the reaction vessel (second thermal cracking zone).

The 126 Kg/hr of the liquid phase introduced into the separator was separated at 370° C. by gravity and centrifugal force into a mesophase-rich pitch containing about 98% of mesophase and a relatively mesophase-deficient pitch containing about 5% of mesophase. The latter pitch was discharged from the separator at a rate of 105 Kg/hr and a portion (95 Kg/hr) of the discharged pitch was recycled to the reaction vessel with the remainder portion (10 Kg/hr) being cooled to 280° C. followed by separation of the mesophase to obtain a mesophase-free pitch. The mesophase-rich pitch (obtained at a rate of 21 Kg/hr) and the isotropic pitch had the properties shown in Table 2.

TABLE 2

| Properties | Liquid Phase | Mesophase-Rich Pitch | Isotropic Pitch |
|---|---|---|---|
| Softening Point (°C.) | 200 | 238 | 198 |
| Volatile matter Content (wt %) | 37 | 20 | 37 |
| Mesophase Content (%) | 20 | 98 | 0 |
| n-$C_7$S* (wt %) | 7 | 2 | 8 |
| n-$C_7$I** (wt %) | 93 | 98 | 92 |
| QI*** (wt %) | 5 | 27 | 0 |

*n-Heptane soluble content
**n-Heptane insoluble content
***Quinoline insoluble content The term "softening point" used herein is determined from a graph which shows the manner in which the pitch sample is softened when one gram of the pitch sample is heated at a rate of 6° C./min under a load of 10 Kg/cm$^2$ by means of a Koka type flow tester (manufactured by Shimadzu Seisakusho Ltd., Japan). The term "mesophase content" used herein is measured in the following manner: A mesophase pitch obtained is cooled under a predetermined condition to obtain a solidified pitch sample. The pitch sample is embedded in a resin (Resin #10 manufactured by Marumoto Industries Co., Ltd., Japan) for fixation of the pitch in the conventional manner. The sample is then polished by means of an automatic optical polisher (manufactured by Maruto Inc., Japan) until the surface of the pitch becomes mirror suitable for a photomicrographic analysis. A polarized light photomicrograph at a magnification of 400× of the polished pitch sample is taken for the determination of its mesophase content in terms of the area (%) of the optically anisotropic domains.

The mesophase-rich pitch which was found to be "reformed mesophase pitch" was spun into fibers and rendered infusible in the air at 280° C. The infusible fibers were calcined at 1300° C. in the atmosphere of nitrogen to obtain carbon fibers having a fiber diameter of 10.5 μm, a tensile strength of 34.0 ton/cm$^2$, a modulus of 1820 ton/cm$^2$ and an elongation of 1.9%. The isotropic pitch which was found to be "dormant mesophase pitch" was also spun into fibers and rendered infusible in an oxidizing gas at 250° C. The infusible fibers were calcined at 1000° C. in the atmosphere of nitrogen to obtain carbon fibers having a fiber diameter of 10 μm, a tensile strength of 20.0 ton/cm$^2$, a modulus of 701.0 ton/cm$^2$ and an elongation of 2.8%.

The overall yields of respective cracked products are summarized in Table 3.

TABLE 3

| | |
|---|---|
| Cracked gas ($C_4$−) | 7 Kg/hr |
| Light oil ($C_4$+ to bp 350° C.) | 10 |
| Middle oil (bp 350–400° C.) | 22 |
| Heavy oil (bp above 400° C.) | 30 |
| Reformed Mesophase Pitch | 21 |
| Dormant Mesophase Pitch | 10 |

EXAMPLE 2

Using the same feed stock as used in Example 1, reformed mesophase pitch and dormant mesophase were produced with the employment of the apparatus illustrated in FIG. 2. Thus, the feed stock after being preheated was continuously fed at a feed rate of 100 Kg/hr to an external heat-type tubular reactor for thermally cracking same at a temperature of 510° C., a pressure of 5 Kg/cm$^2$G for 3 min. The resulting first product was fed to a perfect mixing-type cylindrical reaction vessel having an inside volume of 150 liters and equipped with a stirrer and a scraper. A high temperature steam (700° C.) was continuously supplied from the bottom of the reaction vessel at a controlled rate so that the first product was thermally cracked at a temperature of 440° C. with a partial pressure of the cracked product in the gas phase of 180 mmHg. As described hereinafter, a heavy fraction, after being heat treated, was supplied to the reaction vessel at a rate of 70 Kg/hr.

The overhead product from the reaction vessel was continuously passed to a distillation tower at a rate of 170 Kg/hr to obtain 19 Kg/hr of a light and gas fraction (b.p. of below 350° C.), 56 Kg/hr of a middle fraction (b.p. of 350°–400° C.) and 95 Kg/hr of a heavy fraction (b.p. of 400° C. or more).

A portion (24 Kg/hr) of the middle fraction was recovered as a product while the remaining portion (32 Kg/hr) thereof was fed to a hydrotreating zone for the partial hydrogen treatment in the same manner as in Example 1. A portion (25 Kg/hr) of the heavy fraction was recovered as a product while the remaining portion (70 Kg/hr) thereof was fed to the third thermal cracking zone where it was thermally cracked at a temperature of 510° C., a pressure of 5 Kg/cm$^2$G for a period of time of 3.5 min. The heat treated product from the third thermal cracking zone was recycled to the reaction vessel at a rate of 70 Kg/hr.

The liquid phase in the reaction vessel, which had the physical properties shown in Table 4, was continuously discharged therefrom at a rate of 168 Kg/hr and a portion (32 Kg/hr) thereof was fed to a mesophase hydrogenation reactor for the reaction with a hydrogen-donating oil obtained in the hydrotreating zone in the same manner as in Example 1. The resulting product containing partially hydrogenated mesophase was then recycled to the reaction vessel.

The remaining portion (136 Kg/hr) of the discharged liquid phase was introduced into a separator where it was separated at 372° C. by gravity and centrifugal force into a mesophase-rich pitch containing about 98% of mesophase and a relatively mesophase-deficient pitch containing aboaut 5% of mesophase. The former pitch was obtained at a rate of 22 Kg/hr. The latter pitch was discharged from the separator at a rate of 114 Kg/hr and a portion (104 Kg/hr) of the discharged pitch was recycled to the reaction vessel with the remainder portion (10 Kg/hr) being cooled to 280° C. followed by separation of the mesophase to obtain a mesophase-free pitch. The mesophase-rich pitch and the mesophase-free isotropic pitch had the properties shown in Table 4.

TABLE 4

| Properties | Liquid Phase | Mesophase-Rich Pitch | Isotropic Pitch |
|---|---|---|---|
| Softening Point (°C.) | 202 | 240 | 200 |
| Volatile Matter Content | 34 | 19 | 36 |
| Mesophase Content | 19 | 98 | 0 |
| n-$C_7$S (wt %) | 6 | 3 | 7 |
| n-$C_7$I (wt %) | 94 | 97 | 93 |
| QI (wt %) | 6 | 29 | 0 |

The mesophase-rich pitch which was found to be "reformed mesophase pitch" was spun into fibers and rendered infusible in the air at 280° C. The infusible fibers were calcined at 1600° C. in the atmosphere of nitrogen to obtain carbon fibers having a fiber diameter of 9.9 μm, a tensile strength of 36.0 ton/cm$^2$, a modulus of 2790 ton/cm$^2$ and an elongation of 1.3%.

The overall yields of respective cracked products are summarized in Table 5.

TABLE 5

| | |
|---|---|
| Cracked gas ($C_4$−) | 9 Kg/hr |
| Light oil ($C_4$+ to bp 350° C.) | 10 |
| Middle oil (bp 350–400° C.) | 24 |
| Heavy oil (bp above 400° C.) | 25 |
| Reformed mesophase pitch | 22 |
| Dormant mesophase pitch | 10 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A process of producing carbonaceous pitch, comprising the steps of:

(a) feeding an aromatic heavy oil into a first thermal cracking zone for thermally cracking the aromatic heavy oil and for obtaining a first, thermally cracked product;

(b) introducing the first product into a second thermal cracking zone to which a gaseous heat transfer medium is supplied for direct contact with the liquid phase in the second thermal cracking zone, including the first product, so that the first product is further thermally cracked to form a second, thermally cracked product including distillable cracked components and a mesophase-containing pitch forming a part of the liquid phase, said distillable cracked components being stripped with the gaseous heat transfer medium from the liquid phase;

(c) discharging said liquid phase from the second thermal cracking zone and introducing a first portion of said discharged liquid phase into a first separating zone for separating same into a mesophase-rich pitch having a higher concentration of mesophase than the liquid phase and an isotropic pitch having a lower concentration of mesophase than the liquid phase;

(d) recycling at least a portion of said isotropic matrix pitch to said second thermal cracking zone;

(e) removing said stripped, distillable cracked components overhead from said second cracking zone and introducing same into a second separating zone for separating same into a light fraction, a middle fraction and a heavy fraction;

(f) hydrotreating at least a portion of said middle fraction and/or a portion of said heavy fraction to obtain a hydrogen-donating oil;

(g) reacting said hydrogen-donating oil with a second portion of said discharged liquid phase to hydrogenate said discharged liquid phase;

(h) recycling the reaction product obtained in step (g) to said second thermal cracking zone;

(i) heat treating at least a portion of said heavy fraction and recycling said heat treated portion to said second thermal cracking zone; and (j) recovering said mesophase-rich pitch obtained in step (c).

2. A process as claimed in claim 1, further comprising introducing a portion of said matrix pitch obtained in step (c) into a third separating zone to remove the mesophase contained therein, thereby to obtain substantially mesophasefree isotropic pitch.

3. A process as claimed in claim 1, wherein step (i) includes feeding said at least a portion of said heavy fraction to said first thermal cracking zone for effecting said heat treatment thereof.

4. A process as claimed in claim 1, wherein step (i) includes feeding said at least a portion of said heavy fraction to a third thermal cracking zone for effecting, said heat treatment thereof.

5. A process as claimed in claim 3, wherein said second separating zone is composed of a single distillation tower and the aromatic heavy oil is fed to said distillation tower to drive off its volatile components, the resulting aromatic heavy oil having the volatile components removed being introduced into said first thermal cracking zone as a mixture with said heavy fraction.

6. A process as claimed in claim 3, wherein said second separating zone is composed of primary and secondary distillation towers and step (e) includes introducing said distillable cracked components into the primary distillation tower to separate same into a lighter fraction and a bottom fraction, and introducing said lighter fraction into the secondary distillation tower to separate same into said light fraction, said middle fraction and a residual fraction, and wherein the aromatic heavy oil is fed to said secondary distillation tower to drive off its volatile components, the resulting aromatic heavy oil having the volatile components removed being discharged from said secondary distillation tower as a mixture with said residual fraction, said mixture being admixed with at least a portion of said bottom fraction, and said admixture being introduced into said first thermal cracking zone.

7. A process as claimed in claim 4, wherein said second separating zone is composed of primary and secondary distillation towers, step (e) includes introducing said distillable cracked components into the primary distillation tower to separate same into a lighter fraction and a bottom fraction, and introducing said lighter fraction into the secondary distillation tower to separate same into said light fraction, said middle fraction and a tesidual fraction, and step (i) includes introducing at least a portion of said bottom fraction into said third thermal cracking zone, and wherein the aromatic heavy oil is fed to said secondary distillation tower to drive off its volatile components, the resulting aromatic heavy oil having the volatile components removed being discharged from said secondary distillation tower as a mixture with said residual fraction, said mixture being introduced into said first thermal cracking zone.

8. A process as claimed in claim 4, further comprising admixing said mixture with a portion of said bottom fraction, resulting admixture being introduced into said first thermal cracking zone.

* * * * *

UNITED STATES PATENT AND TRADEMARK OFFICE

CERTIFICATE OF CORRECTION

PATENT NO. : 4,663,021

DATED : May 5, 1987

INVENTOR(S) : Tomio ARAI, Takao NAKAGAWA, Fumio MOGI, and Noriaki OSHIGURI

It is certified that error appears in the above—identified patent and that said Letters Patent is hereby corrected as shown below:

Col. 3, line 32, "ther" should read -- the --.

Col. 4, line 35, "verage" should read -- average --.

Col. 6, line 61, "distillatioh" should read -- distillation --; and line 66, "A" should read -- At --.

Col. 7, line 43, "reation" should read -- reaction --, and lines 50-51, "suitably" should read -- suitable --.

Col. 8, line 51, "discharded" should read -- discharged --.

Col. 14, line 2 (claim 1, line 24), "isotropic" should read -- isotropic matrix --.

Col. 15, line 3 (claim 7, line 9), "tesidual" should read -- residual --.

Signed and Sealed this

Twentieth Day of October, 1987

*Attest:*

*Attesting Officer*

DONALD J. QUIGG

*Commissioner of Patents and Trademarks*